US006179017B1

(12) United States Patent
Walter

(10) Patent No.: US 6,179,017 B1
(45) Date of Patent: Jan. 30, 2001

(54) FILLING ASSEMBLY FOR ASEPTICALLY OPERATING DEEP-DRAWING PACKING MACHINES

(75) Inventor: Peter Walter, Ortenberg (DE)

(73) Assignee: Hassia Verpackungsmaschinen GmbH, Ramstadt (DE)

( * ) Notice: Under 35 U.S.C. 154(b), the term of this patent shall be extended for 0 days.

(21) Appl. No.: 09/491,648

(22) Filed: Jan. 27, 2000

(30) Foreign Application Priority Data

Feb. 3, 1999 (DE) ..... 199 04 131

(51) Int. Cl.[7] ..... B65B 1/04; B65B 3/04; B67C 3/02

(52) U.S. Cl. ..... 141/90; 141/85; 141/89; 141/163; 141/181; 141/234; 141/248; 141/250; 141/284; 134/166 C; 134/170

(58) Field of Search ..... 141/85, 89, 90, 141/91, 129, 131, 135, 163, 181, 234, 248, 250, 283, 284; 134/166 R, 166 C, 170

(56) References Cited

U.S. PATENT DOCUMENTS 4,964,444 * 10/1990 Hanerus et al. ..... 141/90

6,041,834 * 3/2000 Fujikawa et al. ..... 141/172

FOREIGN PATENT DOCUMENTS 2310589 9/1974 (DE) .

* cited by examiner

*Primary Examiner*—Timothy L. Maust
(74) *Attorney, Agent, or Firm*—Collard & Roe, P.C.

(57) ABSTRACT

A filling assembly for an aseptically operating deep-drawing packing machine, wherein a conveying region for the web of packing sheet is provided within a pipe held in sterile condition. Arranged behind a packing sheet-forming station is a filling station comprising at least one loading tube stationary with respect to the conveying region yet displaceable in a direction vertical to the conveying region. In order to enable the packing machine to continue to run also during cleaning of the filling station, two filling stations are arranged in series on the pipe maintained in sterile condition within openings displaceable on the sterile pipe above the conveying region. Only one of the said filling stations is respectively in the operating position while the other of said filling stations is in the cleaning position. The filling stations in view of their displaceable openings on the sterile pipe are reciprocable between an operating position and a cleaning position. For this purpose, the filling assemblies are comprised of a tank part accommodating the loading tube in the cleaning position, and of a loading tube-passage part.

16 Claims, 5 Drawing Sheets

FILLING ASSEMBLY FOR ASEPTICALLY OPERATING DEEP-DRAWING PACKING MACHINES

BACKGROUND OF THE INVENTION

1. Field of the Invention

The present invention is concerned with a filling assembly for aseptically operating deep-drawing packing machines hereinafter briefly referred to as FFS machines.

2. Description of the Prior Art

FFS machines of this type for shaping (molding of, for example, container cases from the web of packing sheet by deep-drawing), loading and sealing of a web of packing sheet moved through the machine are adequately known and used in the art. Depending on the product and the type of offer thereof in the store concerned (in chilled boxes or on non-chilled shelves) measures will have to be taken to insure that, on the one hand, the web of packing material and the covering foil be held in sterile condition and, on the other hand, remain in aseptic condition during movement thereof through the machine, i.e. FFS machines of this type, for aseptical operations, are furnished with a sterile pipe under a slight excess pressure. All these demands are met by the traditional FFS machines of this type which, in addition and in accordance with the requirements of the operators of such machines running at high speed and being expected to involve low stoppage times for inevitable washing and cleaning operations especially of the loading machines or filling stations (e.g. daily basic cleaning and intermediate washing in case of a change from the filling of one product to another). In this respect, the sterile pipe constitutes a problem as the filling station along with its at least one loading tube is to be suitably integrated thereinto, it being required that sterile conditions be maintained and the washing and cleaning demands be met.

In this respect, two basic principles have been conventionally used, i.e. a drainable tank for accommodating the back-flowing cleaning and washing fluid is arranged underneath the molded web of packing sheet in the filling region, and a horizontally displaceable tank collecting the back-flowing cleaning fluid is arranged underneath the metering arrangement, i.e. underneath the at least one loading tube, between the metering arrangement and the sheet of packing material within the sterile pipe. As the collecting tank, in the former instance, is located underneath the web of packing sheet or under the conveying region thereof, respectively, it being necessary for the tank's opening rim to be in closely abutting relationship, during cleaning, with the so-called plate of the metering arrangement, the web of the packing sheet for each cleaning operation is to be severed and removed from the region of the filling assembly inevitably resulting in correspondingly extended stoppages of the whole machine. It is true, the second principle does not require severing and removal of the web of packing sheet, however, the entire adjusting mechanism for displacing the collecting tank is to be located on the sterile pipe and, moreover, drainage of the tank through ports within the wall will have to be safeguarded. None of these two principles enable the FFS machine, during washing and cleaning of the metering arrangement and of the filling assembly respectively, to continue its operation, irrespective of whether it is an intermediate washing or a basic cleaning operation.

SUMMARY OF THE INVENTION

It is the main object of the invention to improve the loading station or the filling assembly, respectively, of an FFS machine of this type to the effect that the machine is able to continue to run also during cleaning operations with very short stoppages only.

Another object of the invention envisages a design of the filling assembly that requires only low retooling efforts for cleaning the machine.

These demands, in the practice of the invention, are met by two options.

The first alternative, according to the invention, resides in that arranged in series, on the sterile pipe, above the conveying region of the web of packing sheet, within adjustable openings, in sealing relationship with the pipe, are two filling stations, wherein alternately, respectively only one filling station is in the operating position while the other of said filling stations is in the cleaning position, that the filling stations in view of the displaceable openings reciprocable between an operating position and a cleaning position respectively comprise a tank part accommodating the filling tube in the cleaning position, and a filling tube-passing part accommodating the filling tube in the operating position, and wherein the two portions together form a movable unit, and that the tube-passing part is provided with a removable closure cap once the tank part is arranged below the filling tube.

The second alternative, in accordance with the invention, resides in that arranged in series on the sterile pipe, above the conveying region of the web of packing material, within openings, in sealing relationship with the pipe, are two filling stations, wherein alternately respectively only one filling station is in the operating position and the other of said filling stations is in the cleaning position, that the filling station is respectively formed of a stationary part for passing the loading tube, accommodating the loading tube in the operating position, and of a separate tank part, which, in the cleaning position, is relatively movable under the raised loading tube, and that the loading tube-passing part, in the cleaning position, is provided with a removable closure cap.

The two filling assemblies of the invention involve the substantial advantage that apart from relatively short stoppage times for retooling the machine, during washing of one of the filling stations, the machine is able to continue to run on the other filling station; however, this requires not only the arrangement of a second filling station but also the specific design of the invention according to the other features. It is true, the structural efforts required for the packing machine is higher; however, these efforts are absolutely offset by the substantially reduced stoppage times. In this connection it will have to be taken into consideration that, hitherto, thorough washing and cleaning operations have taken two to three hours during which the overall operation of such machines had to be interrupted, compared to stoppages taking, at best, 20 minutes according to the solutions of the invention required for exchanging the filling stations or for retooling the machine and for the sterile washing and cleaning of the sterile pipe temporarily to be opened for exchange purposes, and then to be closed again.

Concerning the term "cap-type closure" used for both options it should be noted that this language also implies a so-called nozzle plate which, as a rule, is used only if a metering device or a filling mechanism comprises a plurality of filling tubes. A cap-type closure of this type associated to the filling tube is required in order to close, on the one hand, in the filling position, the passage opening at least to the greatest possible extent and, on the other hand, to close the tank in the washing or cleaning position because, as a rule, the washing and cleaning fluid is supplied under pressure.

The reason that the two alternatives refer to a relative movement is that the filling tube(s) not only per se is (are) vertically but also horizontally displaceable to the then stationary tank (yet to be explained hereinafter in greater detail).

Advantageous developments and forms of embodiment of the two alternatives and their functions will now be explained in closer detail with reference to the special description of some examples of embodiment.

The two filling mechanisms of the invention and other objects and advantages of the invention will appear more fully hereinafter as the description proceeds, with reference being made to the accompany drawings.

DESCRIPTION OF THE PREFERRED EMBODIMENTS

Figure 1:
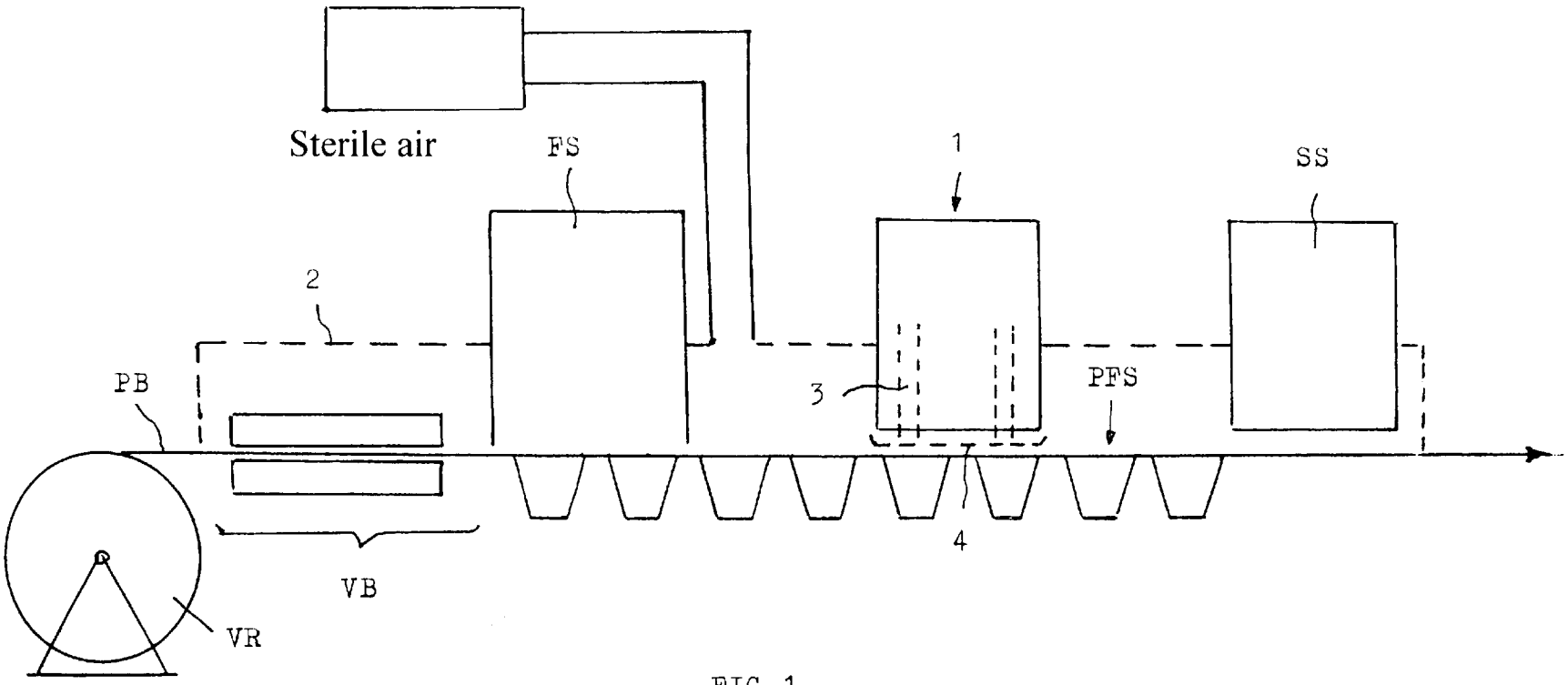
FIG. 1 is a schematically shown side view of an FFS machine.

The filling station for an FFS machine only schematically shown in FIG. 1 comprises, as it conventionally does, at least one filling tube 3 (so-called metering assembly) which with respect to the conveying region PFS is stationary yet displaceable in a direction vertical to the conveying region, with a schematically shown tank 4 for accommodating washing and cleaning fluid formed during washing of the filling tube 3 being associated to the latter. The whole conveying region PFS of the web of packing sheet PB is within a sterile pipe 2 provided, for example, with sterile air and being under a slight excess pressure which, in the example of embodiment according to FIG. 1 is shown in the form of a semi-pipe.

Located ahead of the loading station or filling assembly 1, respectively, which alone is of interest in the present instance, is a molding station FS ahead of which is provided a region of pretreatment VB wherein the web of packing sheet is sterilized and preheated while a sealing station SS is arranged behind the filling assembly 1. None of these machine components arranged on a frame (not shown), except for the filling assembly 1 which alone is of interest in the present instance, needs to be explained in any closer detail because, on the one hand, they are adequately known in the art and, on the other hand, they do not require any modification to realize the present invention.

Figure 2A:
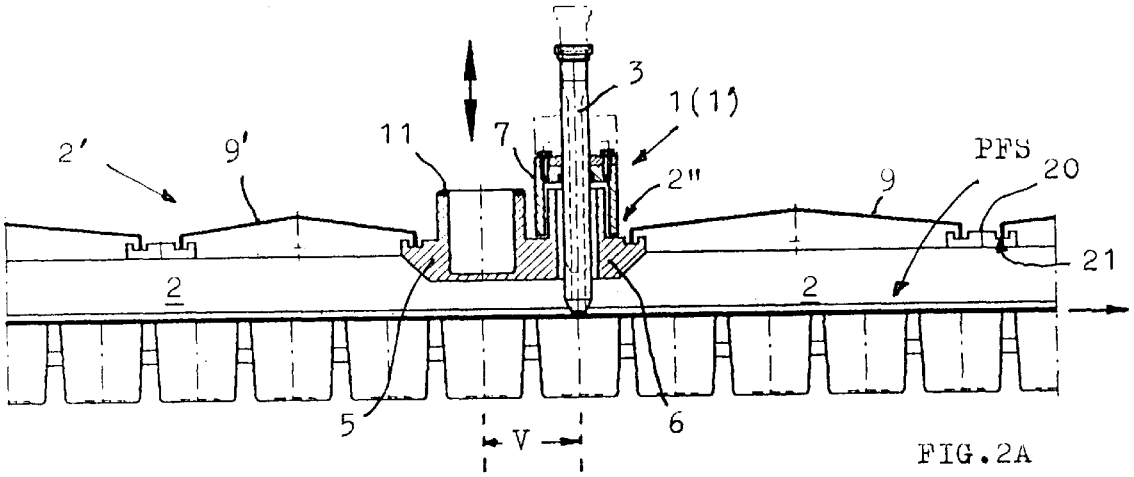
FIG. 2A–C shows one of the filling stations in different operating positions.
Figure 2B:
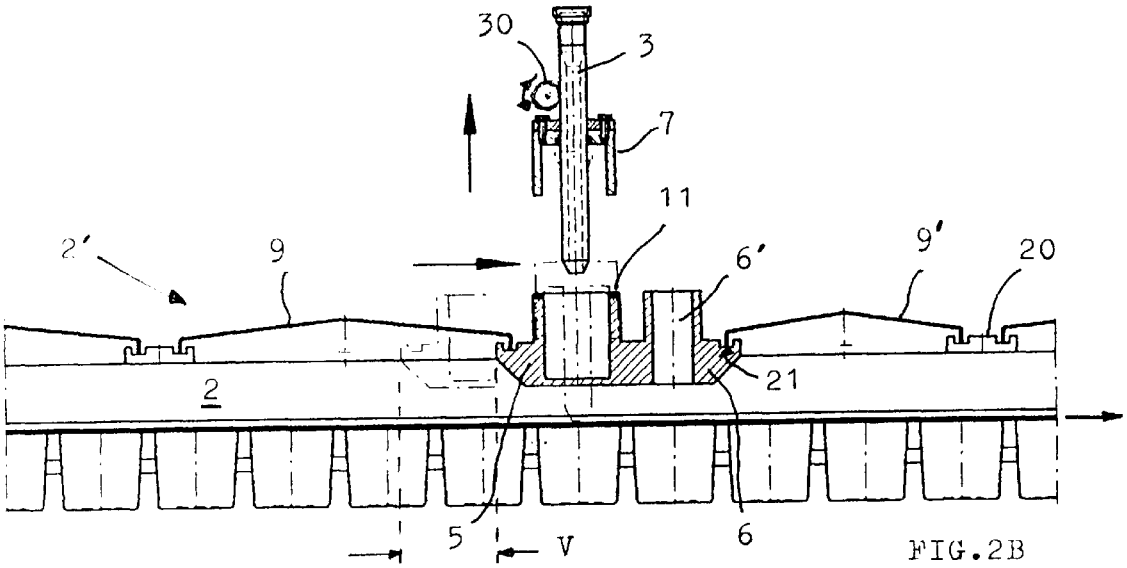
Figure 2C:
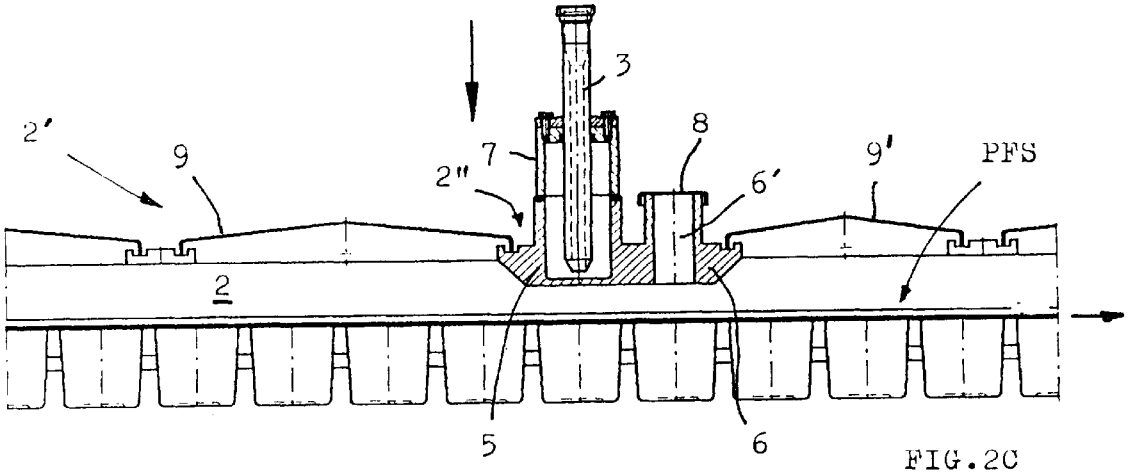
Figure 3:
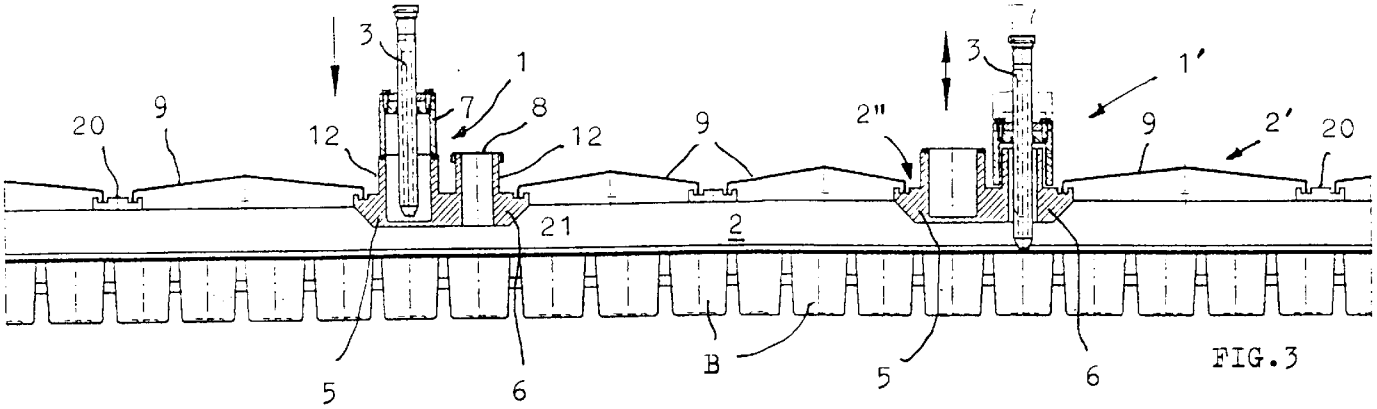
FIG. 3 shows the region of the filling station with the two filling stations according to the first alternative.

Concerning the former alternative, reference is made to FIGS. 2A–C and to FIG. 3. It is important to this form of embodiment of the filling assembly that two loading stations 1,1' be series-arranged on the pipe 2 held in aseptical condition above the conveying region PFS in adjustable openings 2" in sealing relationship with the pipe (see FIG. 3), which loading stations are respectively formed of a tank part 5 and a loading tube-passing part 6 attached thereto, with the tank and passage parts 5,6 being adjustably arranged on the loading tube 3 in parallel to the conveying region PFS, with the loading tube 3 being provided with a cap-type closure 7 fitting both the tank part 5 and the loading tube-passing part 6, and with the loading tube-passing part 6 being provided with a removable cap-type closure 8 once the tank part 5 is positioned under the loading tube 3 (FIG. 2C), which removable cap thus closes the passage opening 6' in the cleaning position according to FIG. 2C. Only one of the loading stations, alternately, is in the operating position (1' to the right in FIG. 3) while the other of said loading stations is in the cleaning position (1, to the left in FIG. 3). In view of the adjustable or displaceable ports 2" the filling stations 1,1' are reciprocably arranged.

Figure 6:
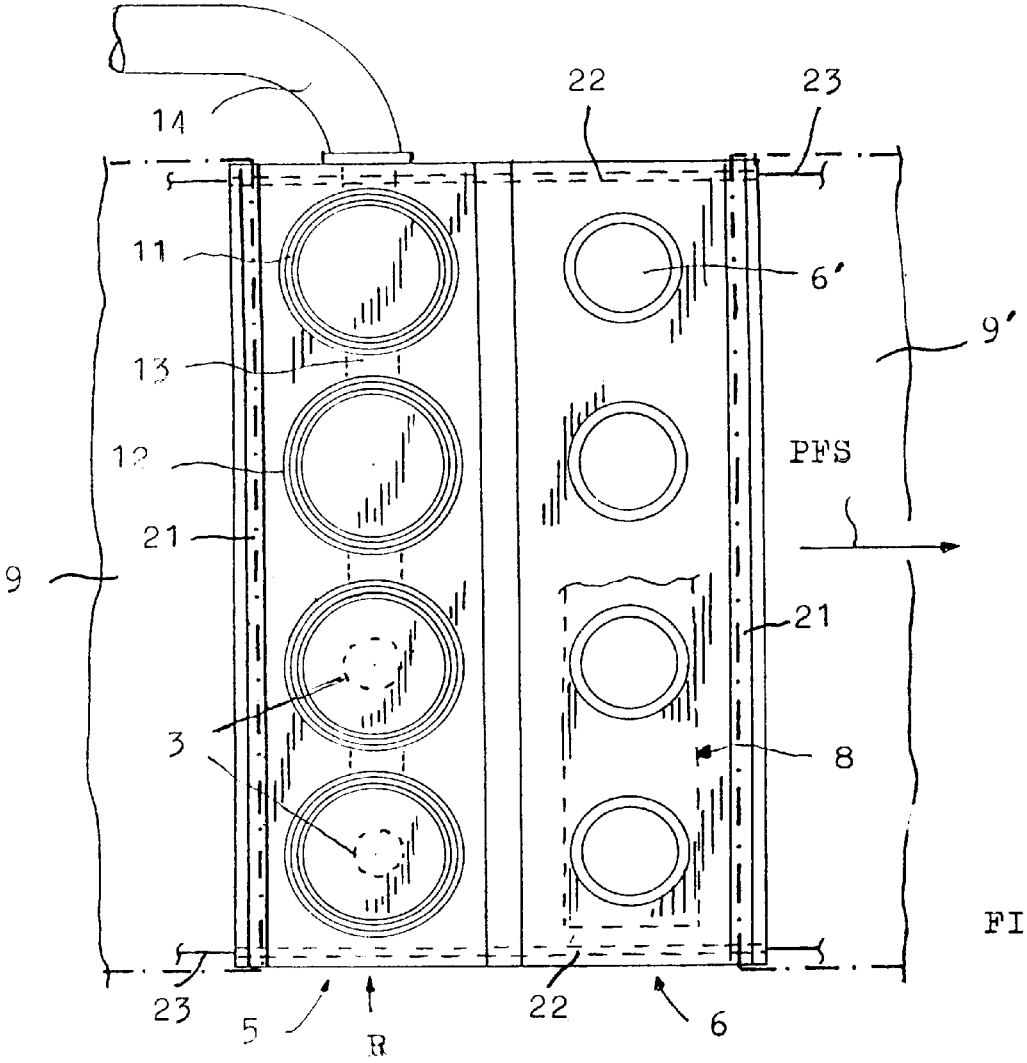
FIG. 6 is a plan view of the tank part and the filling tube-passing part according to FIG. 3 for a plurality of filling tubes arranged in series in a direction transverse to the conveying region.

Concerning the feature of "adjustable or displaceable ports" 2" reference is made to FIGS. 2A,B showing the required displacement V of the tank part 5 and the filling tube-passing part 6 which together form an integral unit. The said displacement V is caused in that the upper limitation 2' of the sterile pipe 2 at least in the mounting area of the two loading stations 1,1' is formed, for example, of cover elements 9,9' mounted in sealing relationship, as shown. To sealingly mount the elements 9,9', cross bars 20 provided with grooves 21 are arranged on the pipe 2; grooves 21 are also provided on the tank and passage parts 5,6 which, in addition, are provided with longitudinal grooves 22 arranged on the bottom side thereof enabling them to be displaceably seated on guides 23. Reference is made, in this respect, also to FIG. 6 showing a plan view of one of the filling assemblies according to FIG. 3.

As mentioned in the afore-going, it is also possible with the form of embodiment according to FIGS. 2A–C, to displace the filling, tube 3, once the tank and passage parts 5,6 are stationary, in the raised position in a direction horizontal from the passage part 6 to the tank part 5 and vice versa.

The means for displacing the loading tube 3 stationary yet displaceable in a direction vertical to the conveying region PFS is shown in FIG. 2B in a highly schematized way only and is designated by reference numeral 30. To discharge the washing and cleaning fluid from the tank 5, the latter is provided with discharge channels 13 (see FIGS. 4,5) connected, for example, to a flexible discharge conduit 14 (FIG. 5) for discharging the washing and cleaning fluid.

FIG. 2A shows the filling assembly in the metering or operating position while FIG. 2B shows the same in the change-over position and FIG. 2C in the washing or cleaning position. To arrive from the normal operating position according to FIG. 2A to the cleaning position according to FIG. 2C, it will be proceeded as follows:

The filling tube 3 shown in FIG. 2A in the loading position is raised and the two adjacent cover elements 9,9' are exchanged while displacing the tank and passage part 5,6 to the right. As the pipe 2 maintained in sterile condition, by withdrawing the filling tube 3 through the passage part 6, per se communicates with ambient air, a design variable in length of the upper pipe cover 9 for displacing the port 2" by the amount V (FIG. 2B) would involve excessive efforts for which reason the form of embodiment as shown comprising displaceable cover elements 9,9' is the preferred one.

Once the change-over position according to FIG. 2B is reached, the loading tube 3 with its cap-type closure 7 is lowered down to the cleaning position according to FIG. 2C, with the bottom edge of the cap-type closure 7 being seated on the upper edge of the tank part 5 provided with a circumferential sealant 11.

To re-close the sterile pipe 2, subjecting it to temporary sterile cleaning operations with a suitable sterile agent (sterile air/steam or the like) a correspondingly dimensioned closure cap 8 is simply placed onto port 6' for passing part 6, see also FIG. 6 showing cap 8 in broken lines.

As in the practice of the invention, a second loading station 1' of a corresponding design (see FIG. 3) is provided, conveyance of the web of packing sheet PB furnished with molded container cases B can now be continued, with ample time being now available for subjecting the loading station 1 holding the cleaning position to a thorough washing and cleaning operation which, as a rule, takes 2 to 3 hours; in the present instance, the time required for cleaning no longer is of relevance as the machine continues to run on the second loading station 1'.

The second alternative of the invention (see in this respect FIGS. 4, 7 and 8) is distinguished from the one described in the afore-going in that the two loading assemblies 1,1' are respectively comprised of a separate tank part 5 and a loading tube-passing passing part 6 stationary relative to the conveying region, with the tank part 5 being arranged above pipe 2, i.e. outside the same, and, via passage part 6 stationary in this instance, with the loading tube 3 in raised condition, being displaceable in parallel to the conveying region PFS. Consequently, it will not be necessary for the two passage parts 6 to be displaced.

Figure 4:
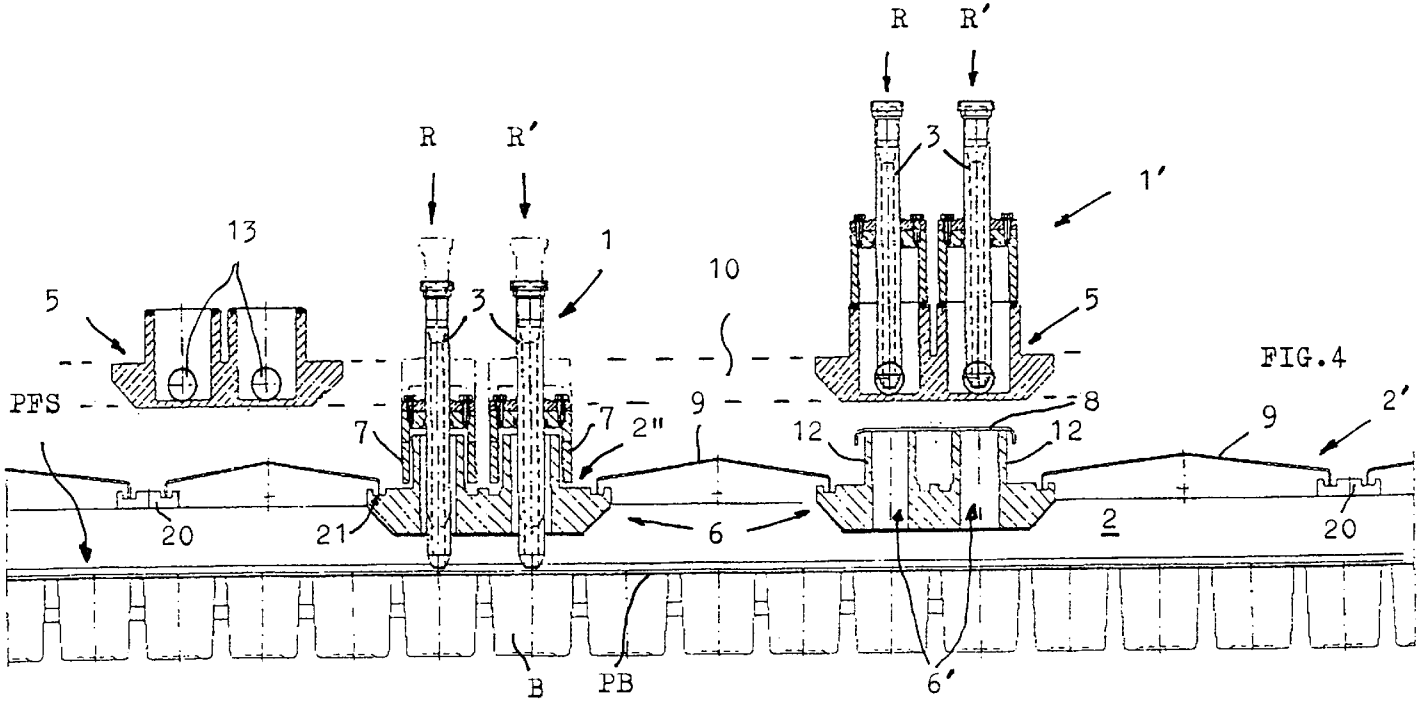
FIG. 4 shows the region of the filling station with the two filling stations according to the second alternative.
Figure 5:
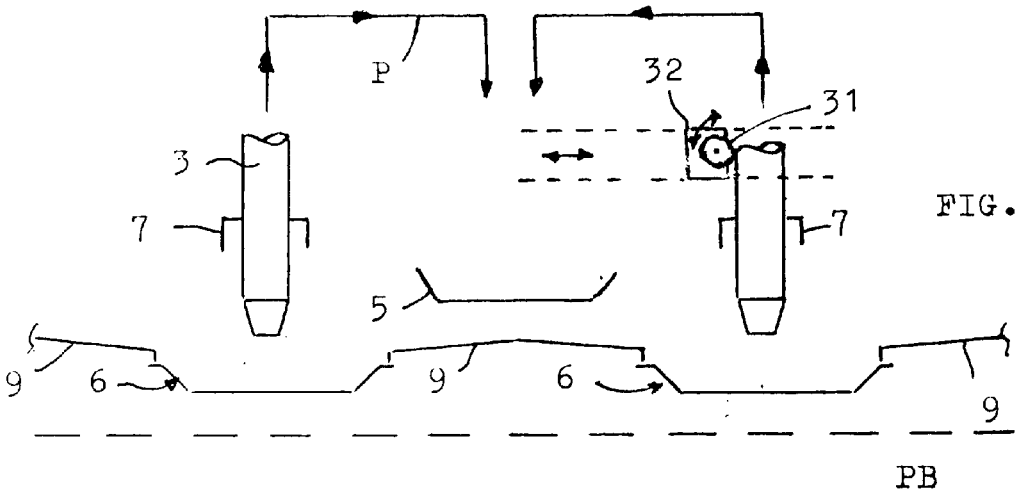
FIG. 5 schematically shows a special principle of displacement in respect of the second alternative.

It is true, in accordance with FIG. 4, a separate tank part 5 can be associated to each stationary passage portion 6; however, apparently, such a provision is not imperative, as the two parts 6, with a correspondingly extended carriage guide 10 only shown in broken lines, can be served by one tank part 5 for cleaning purposes. After the loading tubes 3, which in this form of embodiment are arranged in pairs in each of the loading stations 1,1', having been raised (with the web of packing sheet PB, in the direction of discharge, hence, being cyclically moved in double steps), in the present form of embodiment, the tank part 5 is displaced underneath the correspondingly raised loading tubes 3, and the passage part 6 cleared from the loading tubes 3, as described hereinbefore, during cleaning, is equally closed by a correspondingly dimensioned closure cap 8. Also in this form of embodiment, with the loading tubes 3 in raised condition, it is again possible to horizontally displace the same via the respectively associated tank part 5 then stationary, in the direction of the arrows P as schematically shown in FIG. 5. The displacing mechanism required for this purpose is restricted, with advantage, to upward, downward and transverse displacements of the loading tubes 3 which is caused, for example, by a vertical displacing means 31 and by a transverse displacing means 32 only schematically shown in FIG. 5.

As conveyed by FIGS. 2 to 4, the passage part 6 is provided with sleeves 12 or sleeve-type extensions enclosing the passage ports 6' and fitting into the cap-type closure 7 of the loading tubes 3 so that, with the loading tubes 3 in the lowered loading position, a sort of labyrinth-type sealing of the sterile pipe 2 is formed in this region.

Figure 7:
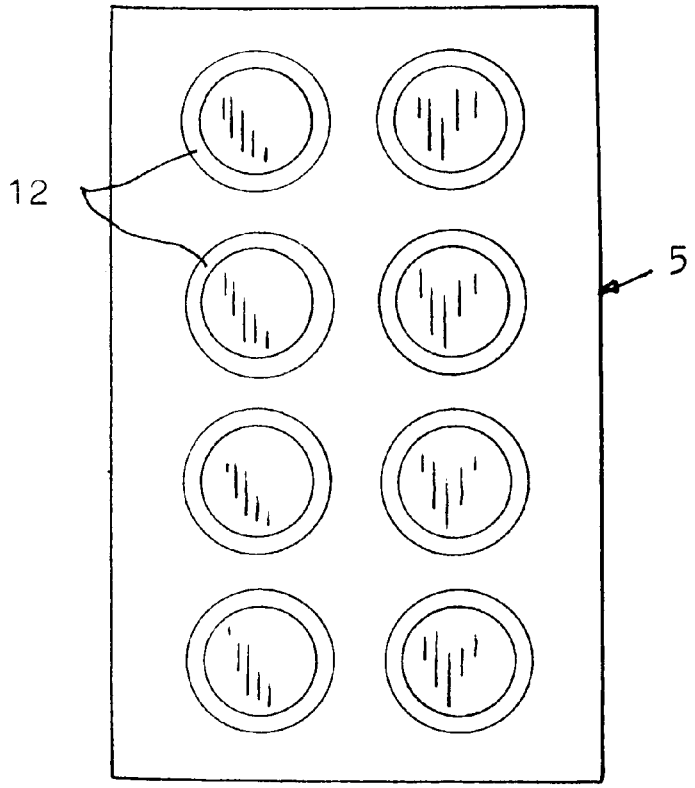
FIG. 7 is a plan view of the tank part according to FIG. 4 for a plurality of filling tubes series-arranged in a direction transverse to the conveying region.
Figure 8:
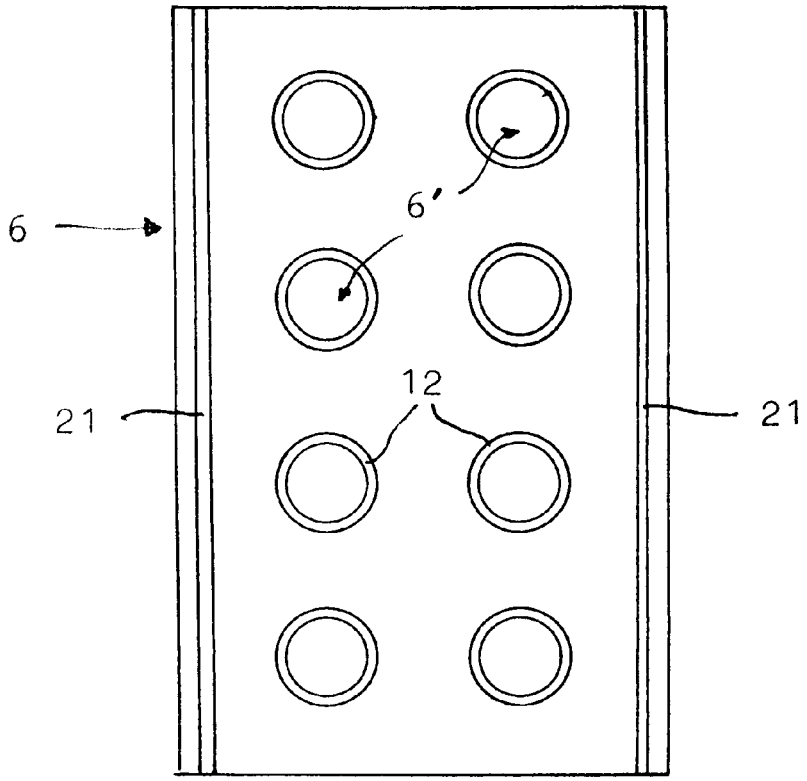
FIG. 8 is a plan view of the filling tube-passing part according to FIG. 4 for a plurality of filling tubes arranged in series in a direction transverse to the conveying region.

It is only for the sake of completeness that FIGS. 6 through 8 show plan views of the tank and passage parts 5,6 according to FIG. 3, forming an integral unit, and of the separate tank part 5 and passage part 6 according to FIG. 4. The arrangement of loading tubes 3 in pairs as shown in FIGS. 4 and 7,8, and the corresponding arrangement in pairs of the tank and passage parts 5,6 can, of course, also be provided in the form of embodiment of the filling assemblies shown in FIG. 3.

Any changes may be made to the construction of the device and the arrangement of parts from those described, without departing from the spirit of the invention, provided, however that such changes fall within the scope of the claims appended hereto:

What I claim is:

1. A filling assembly for an aseptically operating FFS machine whose packing sheet-conveying zone (PFS) is arranged within a pipe (2) maintained in sterile condition, with the filling station (1) being arranged behind the packing sheet molding station (FS) and being comprised of at least one filling tube (3) stationary relative to the conveying zone (PFS) yet displaceable in a direction vertical to the conveying zone (PFS), associated to which tube (3) is a tank (4) for accommodating washing and cleaning fluid arising during washing of the filling tube (3), characterized in that two fillings stations (1,1') are series-arranged on the sterile pipe (2) above the conveying zone (PFS) in displaceable openings (2") in a manner sealable against the pipe (2), with respectively only one of the filling stations (1,1') being alternately in the operating position and the other of said filling stations (1',1) being in the cleaning position, that the filling stations (1,1') in view of the displaceable openings (2") are reciprocable between an operating position and a cleaning position and are respectively formed of a tank part (5) accommodating the filling tube (3) in the cleaning position and a filling tube-passing part (6) accommodating the filling tube (3) in the operating position, and that both part (5,6) together form a movable unit, and that the filling tube-passing part (6) is provided with a detachable closure cap (8) once the tank part (5) is positioned underneath the filling tube (3).

2. A filling assembly according to claim 1 characterized in that a plurality of filling tubes (3) are arranged in side-by-side relationship within a row (R) in a direction transverse to the web of packing sheet-conveying zone and that the said tubes are provided with a common cap-type closure (7) for the correspondingly extended tank part (5), and that the filling tube-passing part (6) is provided with a corresponding number of passage ports (6') that can be covered by a common closure cap (8).

3. A filling assembly according to claim 1, characterized in that associated to the row (R) of filling tubes (3) is at least one additional row (R') of filling tubes (3).

4. A filling assembly according to claim 1, characterized in that the upper limitation (2') of the sterile pipe (2) at least in the mounting region of the two filling stations (1 ,1'), adjacent thereto, is formed of closely mounted cover elements (9, 9').

5. A filling assembly according to claim 1, characterized in that the tank part (5) with the filling tube-passing part (6) thereof on guide (23), in the filling and cleaning position is displaceable, true to position, relative to the filling tube (3) or tubes.

6. A filling, assembly according to claim 1, characterized in that the tank part (5) on the side of the opening, is provided with a circumferential sealant (11) for the cap-type closure (7) to be mounted.

7. A filling assembly according to claim 1, characterized in that the passage part (6) for the filling tube is provided with sleeves (12) enclosing the passage openings (6') and fitting into the cap-type closure (7).

8. A filling assembly for an aseptically operating FFS machine whose packing sheet-conveying zone (PFS) is arranged within a pipe (2) maintained in aseptical condition, with the filling station (1) being arranged behind a packing sheet molding station (FS) and being comprised of at least one metering and filling tube (3) stationary relative to the conveying zone (PFS) yet displaceable in a direction vertical to the conveying zone (PFS), associated to which filling tube (3) is a tank (4) for accommodating washing and cleaning fluid arising during washing of the filling tube (3), characterized in that two filling stations (1,1') are series-arranged on the aseptical pipe (2) above the conveying zone (PFS) in openings (2") in a manner scaled against the aseptical pipe (2), with respectively only one of the filling stations (1,1') being alternately in a operating position and the other of said filling stations (1',1) being in a cleaning position, that the filling stations (1,1') are respectively comprised of a stationary loading tube-passaging passing part (6) accommodating the filling tube (3) in the operating position, and of a separate tank part (5), and that the separate tank part (5), in the cleaning position, is relatively movable underneath the raised filling tube (3), and that the passage part (6), in the cleaning position, is provided with a detachable closure cap (8).

9. A filling assembly according to claim 8, characterized in that a plurality of filling tubes (3) are arranged in side-by-side relationship within a row (R) in a direction transverse to the packing sheet-conveying region (PFS), and that such tubes are provided with a common cap-type closure (7) for the correspondingly extended tank part (5), and that the loading tube-passing part (6) is provided with a corresponding number of passage openings (6') covered by a common closure cap (8).

10. A filling assembly according to claim 8, characterized in that associated to the row (R) of filling tubes (3) is at least one other row (R') of filling tubes (3).

11. A filling assembly according to claim 8, characterized in that the upper limitation (2') of the pipe (2) maintained in sterile condition, at least in the mounting area of the two filling stations (1,1'), adjacent thereto, is formed of closely mounted cover elements (9).

12. A filling assembly according to claim 8, characterized in that the drainable tank part (5), within a carriage guide (10), in the cleaning position is accurately displaceable, true to position, above the covered loading tube-passing part (6).

13. A filling assembly according to claim 8, characterized in that the tank part (5), on the side of the opening, is provided with a circumferential sealant (11) for the cap-type closure (7) to be mounted thereon.

14. A filling assembly according to claim 8, characterized in that the loading tube-passing part (6) is provided with sleeves (12) enclosing the filling tube-passing ports (6') and fitting into the cap-type closure (7).

15. A filling assembly according to claim 8, characterized in that, with a correspondingly extended carriage guide, only one tank part (5) is provided in lieu of two tank parts (5) displaceable in the regions of the two filling stations (1,1').

16. A filling assembly according to claim 8, characterized in that associated to the two loading tube-passing parts (6) stationarily arranged on the sterile pipe (2), above the said pipe (2), is a stationary tank part, and that two filling tubes (3) are alternately displaceable over these two stationary parts (5,6).

* * * * *